US005807197A

United States Patent [19]

Grafton

[11] Patent Number: 5,807,197

[45] Date of Patent: Sep. 15, 1998

[54] FOOTBAG HAVING PHOTOLUMINESCENT FILLER AND BOTH OPAQUE AND LIGHT TRANSMISSIVE PANELS

[76] Inventor: Charles E. Grafton, 1612 Fair Oaks Ave., #20, S. Pasadena, Calif. 91030

[21] Appl. No.: 909,779

[22] Filed: Aug. 12, 1997

[51] Int. Cl.[6] ..... A63B 37/02

[52] U.S. Cl. ..... 473/594; 473/570

[58] Field of Search ..... 473/594, 570, 473/571, 577, 595, 607, 609, 610, 613

[56] References Cited

U.S. PATENT DOCUMENTS

| | | | |
|---|---|---|---|
| 2,020,484 | 11/1935 | Turner | 473/570 |
| 2,849,819 | 9/1958 | Murphy et al. | 473/570 |
| 3,011,048 | 11/1961 | O'Brien | 473/570 |
| 3,351,347 | 11/1967 | Smith et al. | 473/570 |
| 3,580,575 | 5/1971 | Speeth | 473/570 |
| 3,804,411 | 4/1974 | Hendry | 473/570 |
| 4,151,994 | 5/1979 | Stalberger, Jr. | 473/594 |
| 4,551,114 | 11/1985 | Hyman et al. . | |
| 4,701,146 | 10/1987 | Swenson | 473/570 |
| 4,717,158 | 1/1988 | Pennisi | 473/570 |
| 4,930,776 | 6/1990 | Newcomb et al. | 473/570 |
| 4,963,117 | 10/1990 | Gualdoni | 473/610 |
| 5,054,778 | 10/1991 | Maleyko | 473/570 |
| 5,066,011 | 11/1991 | Dykstra et al. | 473/570 |
| 5,080,359 | 1/1992 | Thill | 473/570 |
| 5,228,686 | 7/1993 | Maleyko | 473/570 |
| 5,236,383 | 8/1993 | Connelly | 473/570 |
| 5,388,825 | 2/1995 | Meyers et al. | 473/570 |
| 5,566,953 | 10/1996 | Arriola et al. | 473/594 |

*Primary Examiner*—Steven B. Wong
*Attorney, Agent, or Firm*—Kolisch, Hartwell, Dickinson, McCormack & Heuser

[57] ABSTRACT

A generally spherical soft flexible outer skin is formed of a plurality of panels commonly joined to each other along their respective edges. Certain of the panels are formed of an opaque material while others are formed of a light transmissive foraminous material. The interior of the spherical outer skin is loosely filled with a particulate filler formed of a photoluminescent material. The resulting footbag is activated by exposing the foraminous panels to a strong light source. Thereafter, the photoluminescent particulate filler emits light outwardly through the apertures of the foraminous panels but not through the opaque panels.

4 Claims, 1 Drawing Sheet

FOOTBAG HAVING PHOTOLUMINESCENT FILLER AND BOTH OPAQUE AND LIGHT TRANSMISSIVE PANELS

FIELD OF THE INVENTION

This invention relates generally to footbags and particularly to footbags having light responsive properties.

BACKGROUND OF THE INVENTION

Footbags have attained substantial popularity among a wide variety of age groups and substantially differing athletic capabilities. The basic footbag itself is not unlike the well known and pervasive apparatus often referred to as a "bean bag". In essence, footbags may be described as a combination of a conventional game ball and a bean bag. In a typical footbag, a generally spherical skin is formed of a soft flexible material such as supple leather which is filled with a particulate filler. In most footbags, the amount of filler captivated within the spherical skin is substantially less than the maximum skin volume. The result is a soft, pliable, generally spherical ball-like device which does not bounce when dropped and does not tend to resiliently reassume a spherical configuration when squeezed or deformed. A variety of play patterns have been derived for interacting with a footbag. As the name implies, the most common play patterns involve manipulation or bouncing the ball using the user's feet in a kicking action.

U.S. Pat. No. 4,151,994 issued to Stalberger, Jr. sets forth a GAME FOOTBAG having a cover consisting of two dogbone-shaped pieces of flexible material joined at their peripheries to form a collapsible ball. The fluid material includes a large plurality of polyethylene particles having low resilience. The interaction of the cover with the fluid-like material results in a footbag having a slow action and uniform response to kicking.

In attempting to improve or enhance the attractiveness and appeal of conventional footbags, practitioners in the art have employed various supplemental characteristics. One of the more interesting is provided by utilizing light producing or light interacting apparatus. For example, U.S. Pat. No. 4,963,117 issued to Gualdoni sets forth a SELECTIVELY ILLUMINATED TOY BALL having a footbag including a pliant outer skin made of translucent plastic material. The interior of the footbag is filled with a plurality of translucent or fluorescent beads. An aperture is provided in the skin having sufficient diameter to permit the insertion of a chemical-like stick.

U.S. Pat. No. 4,717,158 issued to Pennisi sets forth a GAME FOOTBAG having a durable and inelastic sphere of soft light emitting plastic material which defines a plurality of air holes therethrough. The sphere is filled with a fluid light emitting particulate pellet filler material. The air holes enable air to escape upon compression while captivating the particulate material. The footbag also includes an opening which permits insertion of a light stick.

In a related art, practitioners have provided an extended variety of lighted game balls for producing a novel and interesting effect. For example, U.S. Pat. Nos. 5,054,778 and 5,228,686 both entitled LIGHTED BALL and both issued to Maleyko set forth lighted balls having high velocity bounce capability formed of a solid spherical body of soft pliable transparent rubber supporting a plurality of light emitted diodes therein. Electrical power means such as batteries and appropriate switches are provided to control the light emission.

U.S. Pat. No. 5,388,825 issued to Myers, et al. sets forth an ILLUMINATABLE BALL having a resilient foam spherical body supporting a battery, a lightbulb and an on/off switch mounted in its interior.

U.S. Pat. No. 5,080,359 issued to Thill sets forth an ILLUMINATED BALL having a single thin skin of light passing material and supporting a source of chemilluminescent light retained therein. The chemilluminescent element is activated prior to insertion or placement into the ball.

U.S. Pat. No. 5,066,011 issued to Dykstra, et al. sets forth a FLASHING LIGHT BALL having a spherical ball supporting a light source therein. A passage extends through the ball communicating with the light source causing the light to flash as the ball rotates.

U.S. Pat. No. 4,551,113 issued to Hyman, et al. sets forth an IMPACT ACTIVATED TOY for use in a child's crib capable of generating melodies in response to impacts.

U.S. Pat. No. 4,701,146 issued to Swenson sets forth an ILLUMINATED INFANT TOY in which a noise-making device within a rattle is also active as a light activation to momentarily light a plurality of lights mounted within the rattle.

U.S. Pat. No. 4,930,776 issued to Newcomb, et al. sets forth a GAME BALL having a lightweight plastic ball defining apertures therethrough covered with a translucent plastic material.

U.S. Pat. No. 5,236,383 issued to Connelly sets forth an ILLUMINATED TOY BALL having a light source within a spherical body and an elongated tether.

U.S. Pat. No. 3,351,347 issued to Smith, et al; U.S. Pat. No. 2,249,819 issued to Murphy, et al; and U.S. Pat. No. 3,580,575 issued to Speeth each set forth various examples of early structures providing game balls having lighted interiors.

While the foregoing described prior art devices have proven to be interesting in many respects and have, to some extent improved the art, there remains nonetheless a continuing need in the art for evermore improved, interesting and amusing footbag type game balls.

SUMMARY OF THE INVENTION

Accordingly, it is a general object of the present invention to provide an improved footbag-type game ball. It is a more particular object of the present invention to provide an improved footbag having an interesting and amusing interactive light characteristic.

In accordance with the present invention, there is provided a footbag comprising: a flexible generally spherical outer skin formed of a plurality of opaque panels and a plurality of light-transmissive panels; and a particulate filler formed of a plurality of photoluminescent particles loosely filling the outer skin, the particulate filler when exposed to a light source emitting light through the light-transmissive panels but not through the opaque panels to cause some portions of the footbag to be dark and other portions to glow in the dark.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
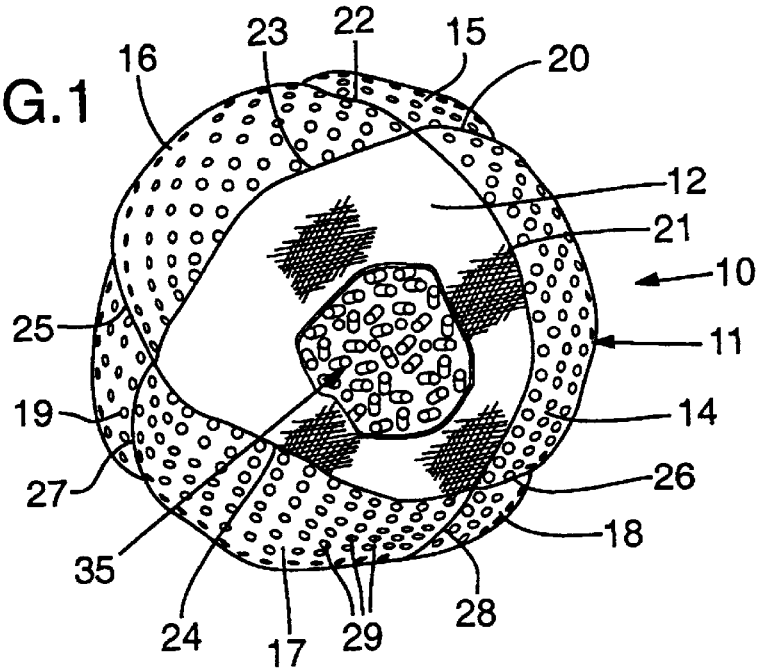
FIG. 1 sets forth a partially sectioned perspective view of a footbag constructed in accordance with the present invention.
Figure 2:
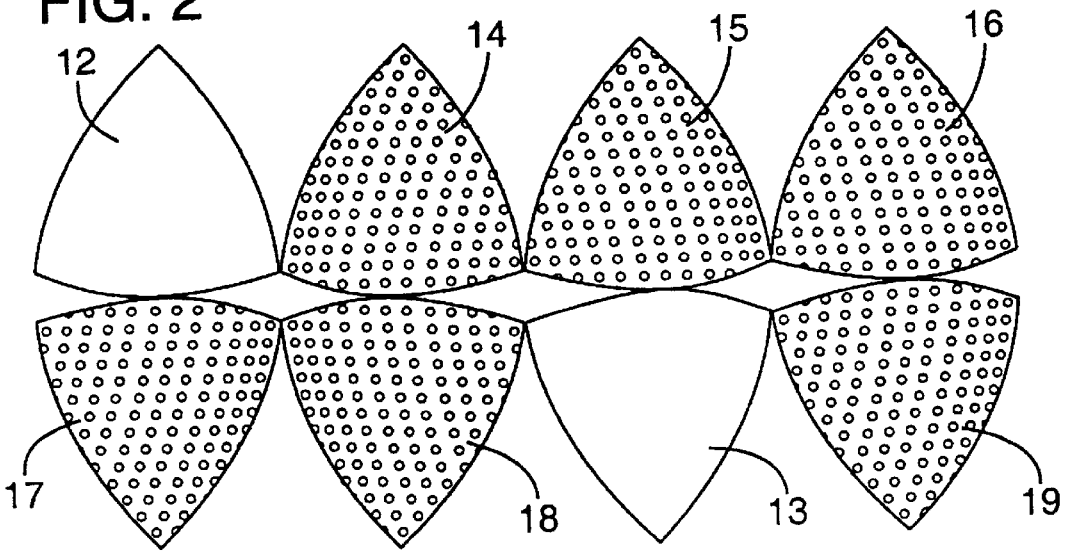
FIG. 2 sets forth an assembly view of the skin portion of the present invention footbag.

FIG. 1 sets forth a partially sectioned perspective view of a footbag constructed in accordance with the present invention and generally referenced by numeral 10. Footbag 10 is fabricated of a plurality of three-sided panels arranged in a pattern as shown in FIG. 2. The panels of footbag 10 comprise two distinct types of materials. Thus, footbag 10 includes an opaque material panel 12 and an opaque material panel 13 (the latter seen in FIG. 2). Footbag 10 also includes a plurality of panels formed of a foraminous material. Thus, panels 14, 15, 16, 17, 18 and 19 are joined in the pattern arrangement shown in FIG. 2 to provide footbag 10 with a flexible loose generally cylindrically shaped outer skin 11. To form footbag 10 from panels 12 through 19, each three-sided panel is joined to three adjacent panels forming seams of the type shown in FIG. 3. Thus, panel 12 is joined to panels 14, 16 and 17 to form seams 21, 23 and 24 respectively. Similarly, panel 15 is shown joined to panels 14 and 16 forming seams 20 and 22 while panel 18 is shown joined to panels 14 and 17 forming seams 26 and 28. Panel 19 is similarly shown joined to panels 16 and 17 forming seams 25 and 27 respectively therebetween.

In accordance with an important aspect of the present invention, footbag 10 further includes a quantity of particulate filler material 35. In its preferred form, filler material 35 is formed of a plurality of extruded, generally cylindrically shaped particles having a ten percent or greater photoluminescent pigment material therein. The result is a particulate filler formed of generally cylindrical elements combining to provide a loose fluid particulate fill which exhibits a strong photoluminescent property.

In accordance with the present invention, footbag 10 is activated by exposing the footbag to a strong light source. In particular, the light source should be directed primarily to foraminous panels such as panels 14 through 18 and 19. The light entering the plurality of apertures such as apertures 29 formed in the foraminous panels energizes the photoluminescent characteristic of the particulate filler. Thereafter, and in accordance with an important aspect of the present invention, footbag 10 will emit light or "glow in the dark" solely through foraminous panels 14 through 18 and 19. In further accordance with the present invention, footbag 10 will not emit light or glow through opaque panels 12 and 13. Thus, when footbag 10 is used in a dark or reduced light environment, the spinning and turning of the footbag during play causes the alternate foraminous glowing panels and opaque dark panels to provide a novel appearance and interesting glowing and flashing action to the footbag.

Figure 3:
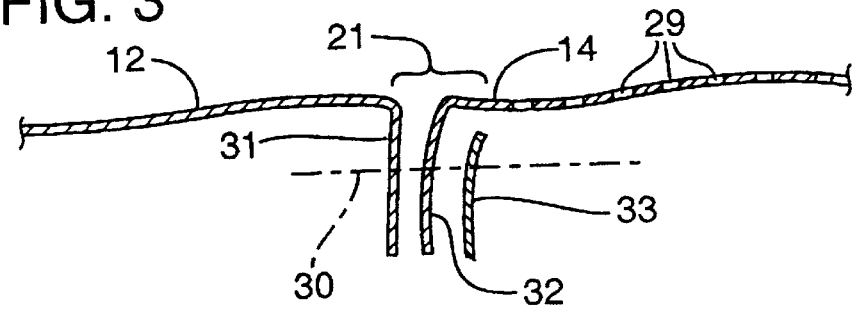
FIG. 3 sets forth a partial section view showing the seam construction of the skin portion of the present invention footbag.

FIG. 2 sets forth the pattern arrangement of panels forming footbag 10. As described above, each of the panels in the present invention footbag is a three-sided panel having a generally curved triangular-like shape which facilitates joining the panels to form an eight-sided or eight-faceted spherical skin. In accordance with the present invention, footbag 10 includes a pair of opaque panels 12 and 13 together with a plurality of foraminous panels 14 through 18 and 19. It will be apparent to those skilled in the art that a generally spherical outer skin may be fabricated for footbag 10 using differently shaped panels in different numbers without departing from the spirit and scope of the present invention. The essential aspect of the present invention is the use of certain panels formed of an opaque material and others formed of a light transmissive foraminous material together with the photoluminescent or glow in the dark particulate filler. FIG. 3 sets forth a partial section view showing a typical seam fabrication by which the edges of panels 12 through 19 are joined to form outer skin 11 (seen in FIGS. 2 and 3). The example shown is that of seam 21 formed between panels 12 and 14. It will be understood, however, that the structure of seam 21 shown in FIG. 3 is equally illustrative of the remaining seams joining the remaining panels to form footbag 10.

More specifically, opaque panel 12 defines a folded edge 31 while foraminous panel 14 defining plural apertures 29 defines a folded edge 32 positioned in an aligned relationship with folded edge 31. For additional strength, a reinforcing strip 33 is positioned against folded edge 32. Thereafter, folded edges 31 and 32 together with reinforcing strip 33 are brought together in an overlying relationship and a sewn stitch forms a stitch line 30 as panels 12 and 14 are sewn together forming seam 21.

What has been shown is a novel footbag having a photoluminescent filler which utilizes both opaque and light transmissive panels to provide a novel optical effect as the photoluminescent filler emits light through the light transmissive panels but not through the opaque panels. The footbag of the invention may be fabricated using different number of panels forming a spherical outer skin and a variety of particle fillers having a photoluminescent or glow in the dark capability.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A footbag comprising:

a flexible generally spherical outer skin formed of a plurality of opaque panels and a plurality of light-transmissive panels; and a particulate filler formed of a plurality of photoluminescent particles loosely filling said outer skin, said particulate filler when exposed to a light source emitting light through said light-transmissive panels but not through said opaque panels to cause some portions of said footbag to be dark and other portions to glow in the dark.

2. A footbag as set forth in claim 1 wherein said light transmissive panels are formed of a foraminous material.

3. A footbag as set forth in claim 2 wherein said plurality of opaque panels is two and said plurality of light transmissive panels is six.

4. A footbag as set forth in claim 3 wherein each of said panels in said first and second pluralities is three-sided.

* * * * *